US005979204A

United States Patent [19]

Stange

[11] Patent Number: 5,979,204

[45] Date of Patent: Nov. 9, 1999

[54] QUICK CHANGE TOOLING METHOD AND APPARATUS

[75] Inventor: Ronald R. Stange, Littleton, Colo.

[73] Assignee: Tools For Bending, Inc., Denver, Colo.

[21] Appl. No.: 09/029,148

[22] PCT Filed: Jul. 1, 1996

[86] PCT No.: PCT/US96/11180

§ 371 Date: Feb. 27, 1998

§ 102(e) Date: Feb. 27, 1998

[87] PCT Pub. No.: WO98/00250

PCT Pub. Date: Jan. 8, 1998

[51] Int. Cl.[6] ..... B21D 7/04; B21D 9/05

[52] U.S. Cl. ..... 72/159; 72/150

[58] Field of Search ..... 72/149, 150, 151, 72/152, 154, 155, 157, 158, 159, 369, 387, 388, 446, 481.1; 299/95, 109, 113, 114

[56] References Cited

U.S. PATENT DOCUMENTS 4,083,216 4/1978 Gilkerson et al. ..... 72/149

5,165,148 11/1992 Fleischer et al. ..... 292/113

5,257,839 11/1993 Nielsen et al. ..... 292/DIG. 49

5,301,530 4/1994 Beelen et al. ..... 72/155

*Primary Examiner*—Rodney Butler

*Attorney, Agent, or Firm*—John E. Reilly

[57] ABSTRACT

A quick change tooling method and apparatus has been devised for tube bending operations in which the bend die, clamp die and pressure die as well as mandrel and wiper die, if required, are preassembled along with a tube corresponding to the tube to be bent in that particular die assembly by releasable latches or other types of releasable connectors; and each preassembled die set as described can be removed, transported and relocated on a bending machine as a complete assembly and in exact aligned operating position without readjustment and pressure setting each time that the die set is installed. A lift mechanism is provided to facilitate lifting of each die set onto and from the bending machine as well as to automatically locate each die set in proper aligned position on the machine.

21 Claims, 4 Drawing Sheets

QUICK CHANGE TOOLING METHOD AND APPARATUS

BACKGROUND AND FIELD OF INVENTION

This invention relates to tube bending apparatus, and more particularly relates to a novel and improved method and apparatus for quickly and accurately changing die sets for different-sized tubing to be bent or for different types of tube bending operations.

Tube bending operations require precise alignment between a bend die, pressure die and clamping die for each size of tube to be bent. In many cases, a wiper die is required along with a mandrel which is inserted into the tube portion to be bent. In the standard bending operation, holders are provided on the bend die table which are movable into engagement with the bend and clamping dies, and the pressure die is advanced linearly as the bend die is rotated with the tube to be bent being securely clamped in complementary grooves therebetween to undergo bending and assume the configuration of the grooves as pressure is applied. In many tube bending operations, a mandrel must be inserted into the tube to be bent in order to prevent wrinkling or collapse of the portion of the tube being bent; and in many cases, a wiper die is employed in cooperation with the pressure die to regulate the pressure applied to the tubing during the bending operation.

In changing the various dies for different-sized tubing, the standard practice has been to individually remove the dies and reassemble a new die set onto the table which is time-consuming and results in considerable downtime. In certain tube bending applications, it has been proposed to be able to remove more than one component part of the die set in one step or to provide special devices to facilitate replacement of the die set in an effort to reduce downtime and, for example, reference is made to U.S. Pat. Nos. 4,178,788 to R. T. Zollweg et al, 4,355,525 to J. W. Carson, 4,967,585 to S. Grimaldo, 5,148,695 to H. S. Ellis, 5,339,670 to A. Granelli, 5,426,965 to W. G. Hopf and 5,499,521 to M. E. Luikart et al. Nevertheless, to the best of our knowledge, no one has devised a one-step operation in which component dies of the tube bending apparatus can be removed from the bending table and stored in assembled form so as to retain the same precise alignment and relationship established from the previous bending operation. In this way, the apparatus can be remounted on the table as one unit and remain in the desired relationship so as not to require extensive set-up time in preparing for the next bending operation for that particular sized tubing; and further wherein the die set or kit is so assembled and arranged as to facilitate automated removal and reinstallation with respect to a standard die table as well as the ability to rapidly and accurately locate one or more die sets at one time with respect to the bend die table.

SUMMARY OF THE INVENTION

It is therefore an object of the present invention to provide for a novel and improved quick-change tooling method and apparatus for tube bending operations.

It is another object of the present invention to provide for a novel and improved means to preassemble die sets employed in tube bending operations into a unitary assembly which can be removed from and replaced on a tube bending table in a one-step operation thereby substantially reducing downtime between tube bending operations.

It is a further object of the present invention to provide for a novel and improved method of preassembling tube bending dies into a unitary assembly for one-step removal and replacement of die sets into accurate alignment with the bender machine for different sized tubing and different types of tube bending operations.

It is a still further object of the present invention to provide for a method of bending different sized tubing wherein die sets for each sized tubing are preassembled and can be automatically removed and replaced with another die set without requiring readjustment or realignment of the dies in each set.

In accordance with the present invention, a preassembled die set has been devised for tube bending apparatus wherein the die set is comprised of a bend die, clamp die and pressure die adapted to be mounted on a spindle of a tube bending table, the improvement comprising first means releasably interconnecting the pressure die and clamp die to the bend die in predetermined, aligned relation to one another and to the bend die, and handling means for engaging the die set in order to simultaneously lift and remove said dies comprising each die set from the table. Preferably, the handling means is defined by lift means operative to lift each die set from the table and replace with another die set by lowering the other die set onto the table and locating it in prealigned relation to the table. Furthermore, each preassembled die set preferably includes a straight or bent tube corresponding to the size of tube to be bent that remains in the die set in order to permit the connecting means to maintain the dies of each set in aligned relation to one another. Many tube bending operations require the use of a wiper die and mandrel and which elements may also comprise a part of each presassembled die set when needed.

The method of changing die sets in accordance with the present invention comprises the steps of interconnecting each of the die sets in prealigned relation to one another for bending a selected size of tube, mounting a selected one of the die sets on a spindle support of a tube bending machine with the pressure die and clamp die aligned with one another and with the bend die, positioning clamp and pressure die holders into engagement with the one die set and releasing the connectors from engagement with the one die set, bending one or more tubes of a selected size by inserting into facing tube grooves between the clamp die, pressure die and bend die and rotating the bend die to bend the tube so inserted, and releasing the clamp and pressure die holders and connecting the connectors to releasably interconnect the dies of the one die set followed by lifting the one die set and removing from the spindle support. Preferably, a tube corresponding to the size of tube to be bent is left in the one die set prior to removal so that the dies maintain their prealigned relation when stored and later replaced on the spindle for another tube bending operation of that size tube.

The above and other objects of the present invention will become more readily appreciated and understood from a consideration of the following detailed description of preferred and modified forms of the present invention when taken together with the accompanying drawings in which:

DETAILED DESCRIPTION OF PREFERRED EMBODIMENT

Figure 1:
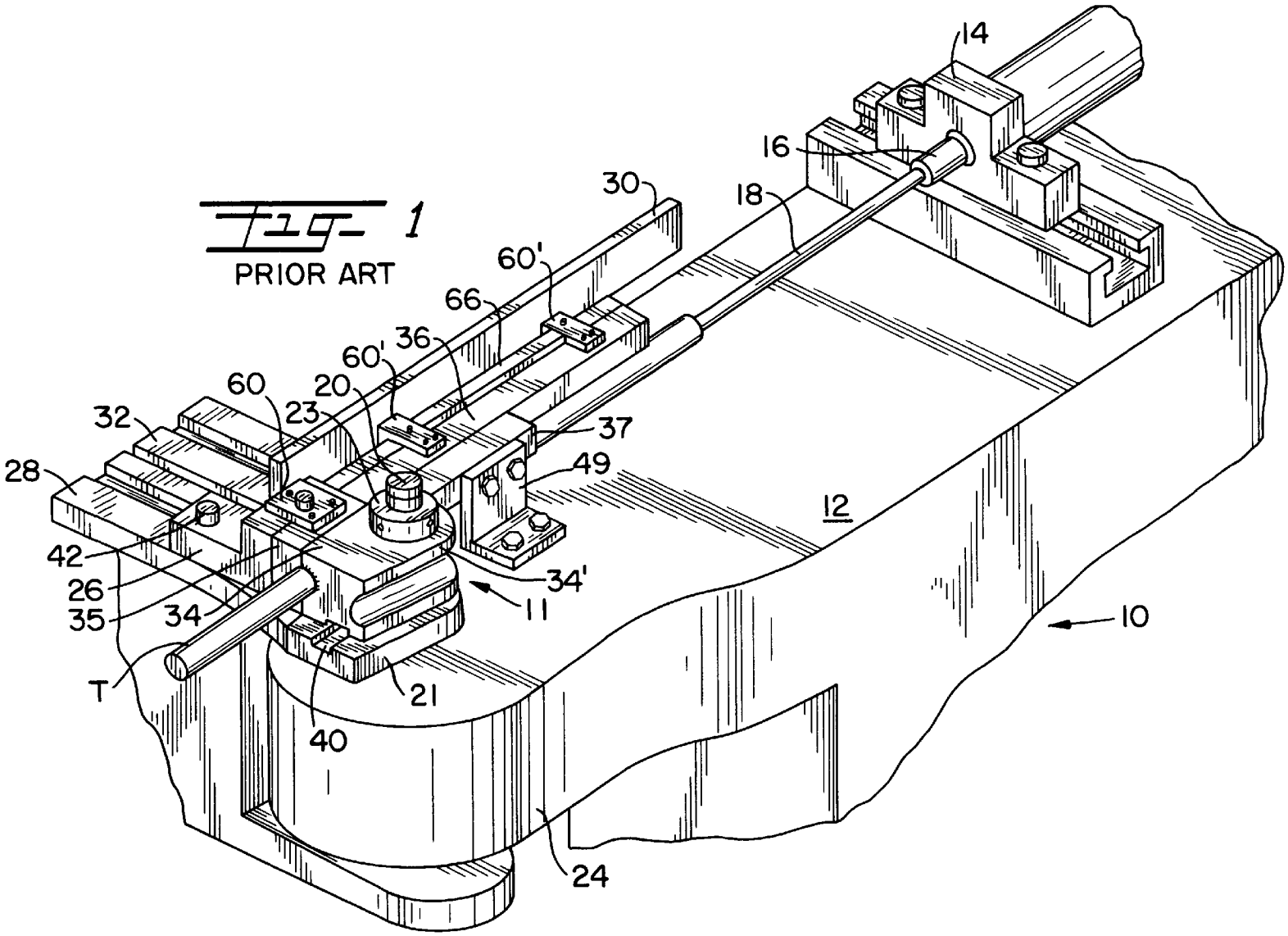
FIG. 1 PRIOR ART
FIG. 1 is a perspective view illustrating a conventional form of tube bending machine including a die set consisting of a bend die, clamp die, pressure die and wiper die in assembled relation to the machine with a mandrel inside of a tube to be bent.

There is shown in FIG. 1 a conventional tube bending machine 10 having a main upper bed or table surface 12 upon which is mounted a mandrel retract cylinder 14 having a plunger 16 affixed to an end of a mandrel rod 18 for insertion of a mandrel, not shown, into a tube T. A spindle 20 projects upwardly from a swing arm 21 in order to control rotational movement of the swing arm 21 around overhanging portion 24 of the machine. Although not shown, typically the machine 10 includes a degree of bend adjustment which is regulated by an electronic control panel, in accordance with the degree of bend desired. An associated clamping die holder 26 is slidable on a way 28. Additionally, a pressure die holder 30 is slidable on way 32, the clamp die holder 26 and pressure die holder 30 being movable into and away from the dies to be described in a well-known manner. One suitable form of tube bending machine is the TBH-40, manufactured and sold by Tools For Bending, Inc. of Denver, Colo.

Figure 2:
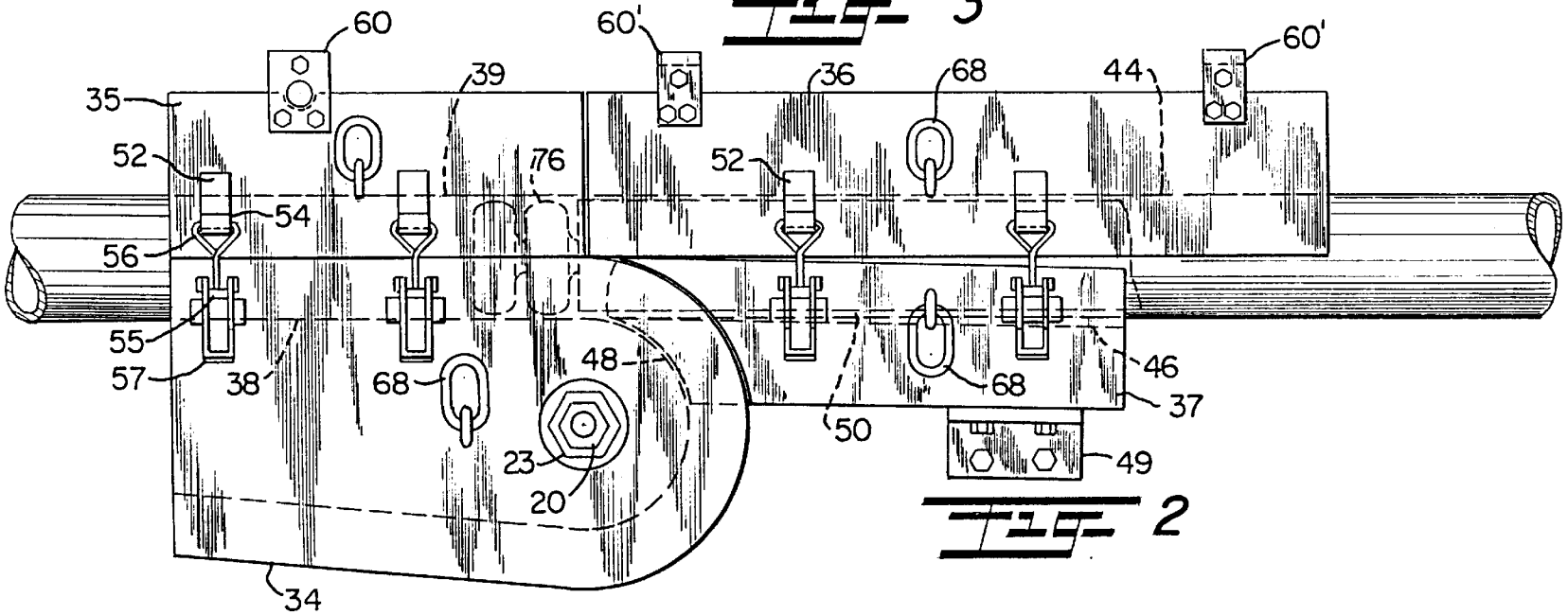
FIG. 2 is a top plan view of a preferred form of preassembled die set including a tube to be bent.

A preferred form of die set 11 is illustrated in FIG. 2 and is broadly comprised of a bend die 34, a clamp die 35, pressure die 36 and wiper die 37. Each of the dies 34 to 37 is of conventional construction. For example, the bend die 34 is in the form of a generally U-shaped block of hardened tool steel or alloy steel, heat-treated and nitrided, a tube groove 38 in its outer peripheral wall between spaced, parallel top and bottom surfaces, and a semi-circular end portion 34' as shown in FIG. 1. The clamp die 35 is in the form of a generally rectangular block having a tube groove 39 in one side wall in facing relation to one side of the bend die, the tube groove 39 being complementary to the groove 38 in the bend die. Typically the tube grooves of the bend die 34 and clamp die 35 are of generally semi-circular configuration conforming to the size and configuration of the tube T so that each encircles one-half of the tube. A locking screw 42 in the clamp die holder 26 serves to adjust or tighten the clamp die 35 against one side of the bend die 34 with the tube T interposed therebetween during a tube bending operation.

The bend die includes a bore dimensioned to receive the upper end of the spindle 20 and a mounting plate 21 is keyed to the lower end of the spindle 20. One or more jam nuts 23 are threaded onto the upper end of the spindle 20 to retain the bend die 34 securely in position. The bottom surface of the die, as shown in FIG. 1, is recessed at 40 to define a keyway aligned with a corresponding keyway in the upper surface of the mounting plate 21 for the purpose of receiving a key, not shown, when the dies are installed in a manner to be described on the bending machine 10. In normal practice, the clamp die 35 is individually positioned on the clamp die holder 26 and, with the tube T held in the bend die 34, the clamp die is advanced by the clamp die holder 26 against the tube and adjusted for vertical alignment as well as for parallel contact with the entire length of the die 35 along the bend die 34.

The pressure die 36 is elongated and of generally rectangular cross-section except for a tube groove 44 along one side wall in facing relation to the bend die tube groove 38 and a wiper die tube groove 46. The pressure die 36 is aligned in end-to-end relation to the clamp die and is advanced by the pressure die holder 30 into engagement with the tube T and adjusted for vertical alignment as well as for constant pressure with the tube T along its length.

The wiper die 37 is typically employed when a mandrel is required for the bending operation and is of elongated configuration and of generally rectangular cross-section but including the tube groove 46 which engages the tube T on the same side as the bend die 34. The wiper die 37 includes an arcuate end portion 48 which is of a corresponding curvature to the end portion 34' of the bend die 34 and is advanced as far as possible into engagement with the bend die 34, then abutting or secured to a wiper die holder 49. The wiper die holder is affixed in a conventional manner to the table 12 of the bending machine 10 and has an upstanding leg to which the wiper die may be secured by suitable fasteners. Again, when individually used, the wiper die must be adjusted for rake and vertical alignment.

The die set is completed by a mandrel 50 which is inserted into the tube and attached to the leading end of the mandrel rod 18. Typically, the mandrel 50 is made up of a series of balls which are free to follow the curvature of the tube T when being bent while supporting the interior wall surface of the tube T to prevent collapse or wrinkling. Typically, the mandrel must be inserted into the tube and adjusted lengthwise by trial and error until the optimum point of extension through the tube is reached.

In the conventional die set as hereinbefore described, the customary practice is to reassemble each individual die 34–37 as well as the mandrel 50 in position on the bending machine and follow the necessary adjustment procedure to establish the desired pressure on the tube to be bent as well as vertical and tangential alignment of the dies and is therefore time-consuming and results in substantial downtime. In certain bending operations, a wiper die is not required and, for example, in some bending applications it is not necessary to employ a wiper die or mandrel, for example, as disclosed in our U.S. Pat. No. 4,765,168 for METHOD AND APPARATUS FOR BENDING TUBING. In any event, depending upon the particular tube bending requirements, the present invention enables preassembly of the components making up the die set so that the entire die set can be mounted on the spindle and properly aligned in a one-step operation not requiring the preliminary adjustment procedures as described. To this end, as shown in FIG. 2, the clamp die 35 and bend die 34 are releasably interconnected by draw latches 52 affixed to the top surfaces of the dies 34 and 35 at longitudinally spaced intervals across interfacing edges of the respective members; or the edges may be interlocked in a well-known manner. Preferably, each latch 52 includes a keeper on the top surface of the clamp die having a hooked end or return 54, and a toggle-type latch member 55 affixed to the top surface of the bend die 34 with a loop-shaped end 56 which can be passed over the hook end 54 by pivoting of a toggle, member 57. The keeper 53 and latch 55 are permanently affixed to the top surfaces of the respective members by suitable fasteners, such as, screws, not shown. Correspondingly, the pressure die 36 and wiper die 37 are releasably interconnected to one another by latch members 52 at longitudinally spaced intervals. Preferably, the latch elements 54 include an adjusting mechanism to regulate the amount of pressure exerted by the latch in drawing the dies together when in the closed or latched position so that fine adjustments can be made once the latches are permanently installed or affixed onto the dies. In this relation, the desired amount of pressure between dies is established with an appropriate sized tube T inserted between the interfacing or complementary tube grooves. One suitable form of draw latch is the OJOP Latch sold by Paul Moore Company of Cincinnati, Ohio, and it will be evident that other forms of latches, clamps or bolts may be utilized to retain the dies in their exact aligned operating position with respect to one another.

As further shown in FIG. 2, in establishing vertical adjustment of the clamp die 35 and pressure die 36 with respect to one another and to the bend die, a series of conventional hanger brackets are provided including a clamp die hanger bracket 60 located somewhat intermediately between the clamp die latches 52, one side of the bracket 60 fastened to the top surface of the clamp die and the other side overhanging the clamp die holder 26. The fasteners may take the form of vertical adjustment screws which serve to properly position the clamp die with its top surface flush with that of the bend die 34. In addition, the clamp die bracket 60 includes a half-round mounting shaft, not shown, which locates the clamp die 35 in relation to tangent of bend. In a similar manner, hanger brackets 60' are mounted on the pressure die 36 at spaced longitudinal intervals with overhanging portions of each hanger bracket affixed to pressure die spacer bar 66, as shown in FIG. 1. Additionally, lift rings 68 are anchored at spaced intervals to the dies 34–37 to facilitate lifting of the die set onto and from the bending machine, such as, by means of an overhead crane or a lift mechanism of the type hereinafter described and shown in FIGS. 4 and 5.

Figure 3:
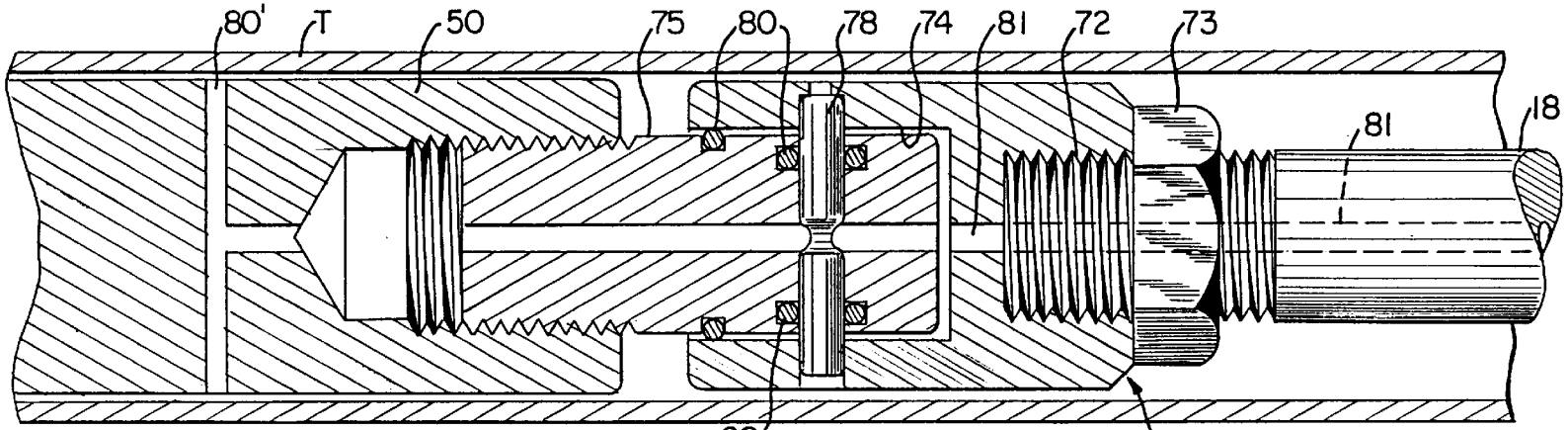
FIG. 3 is a longitudinal sectional view of a preferred form of mandrel disconnect for a mandrel inserted into each tube to be bent.

In order to insert the mandrel 50 into the tube to be bent, a mandrel locator 70 is mounted on the end of the mandrel rod 18, as shown in FIG. 3, the locator 70 including a threaded counterbore 72 to receive a threaded end of the mandrel rod 18 with a lock nut 73 disposed at the entrance to the counterbore. A second counterbore 74 is oppositely directed to the first counterbore and somewhat enlarged to receive a cylindrical extension 75 of the mandrel 50. The mandrel itself is standard and includes a series of generally ball-shaped joints 76 as illustrated in FIG. 2; and the extension 75 is releasably attached to the locator 70 by a locking pin 78 extending transversely across the counterbore 74 and through a transverse bore in the extension 75. Suitable O-rings 80 are disposed at opposite ends of the locking pin as well as between the counterbore 74 and extension 75, and a lube passage 81 extends centrally through the rod 18, intermediate wall of the locator, extension 75 and mandrel 50 to permit injection of a suitable lubricant into the passages 80' leading to the outer periphery of the mandrel 50. The mandrel locator 70 facilitates installation of the mandrel into the tube to be bent and remains with the preassembled die set so that all that is necessary is to insert the cylindrical extension 75 into the counterbore 74 and engage locking pin 78.

Figure 4:
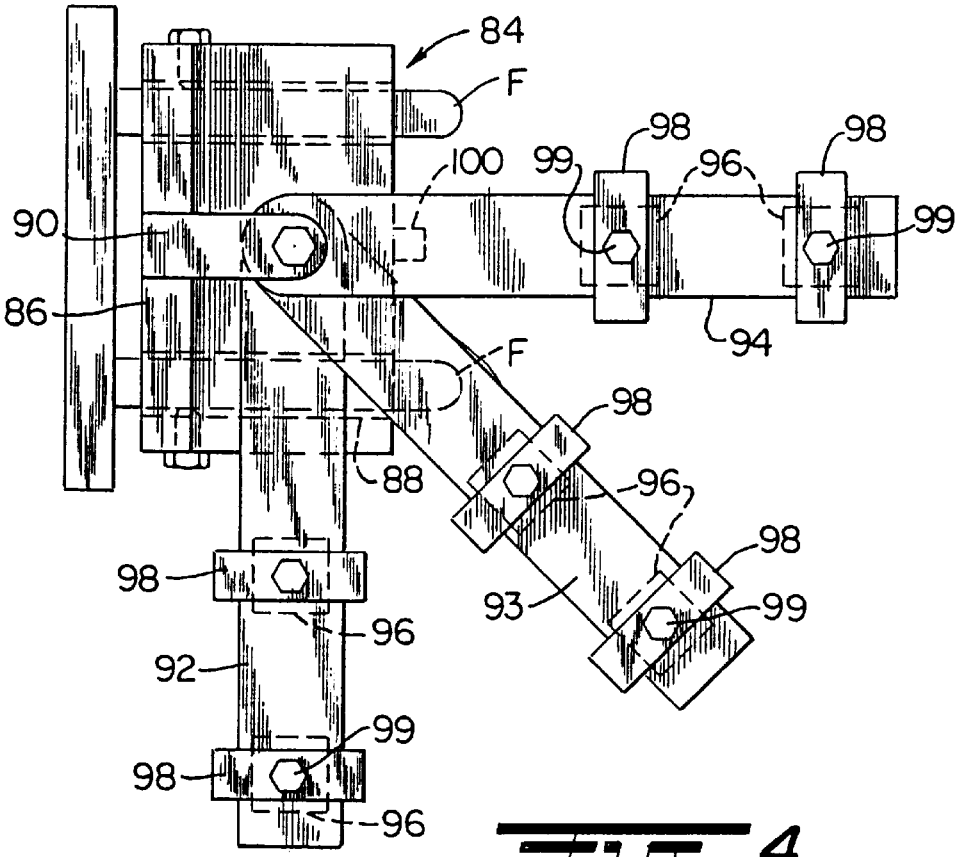
FIG. 4 is a top plan view of a lift mechanism for removal and replacement of a preassembled die set in accordance with the present invention)
Figure 5:
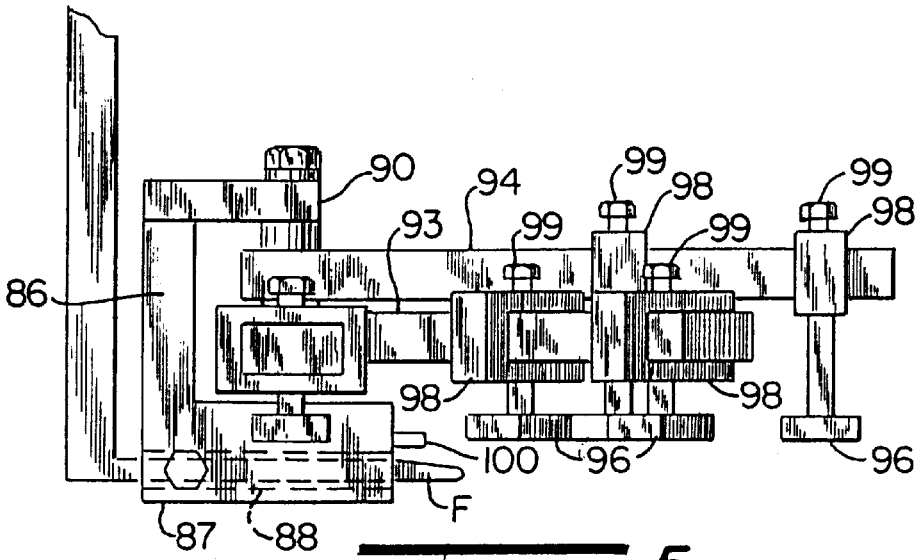
FIG. 5 is a side view in elevation of the preferred form of lift mechanism shown in FIG. 4.

Various types of lift mechanisms can be employed for installation and removal of the die set 11 with respect to the bending machine. A lift mechanism 84 is illustrated in FIGS. 4 and 5 having an adapter frame 86 and a base 87 provided with spaced openings 88 for insertion of tines F of a standard forklift truck, not shown. An upper swivel mount 90 on the frame 86 carries a plurality of support arms 92, 93 and 94 for horizontal swinging movement about the vertical axis of the swivel mount 90. Each of the arms 92–94 carries radially spaced electromagnets 96 each of which is suspended from a lift collar 98 and adjustably secured to one of the arms 92–94 by lock screws 99.

A locating key 100 is disposed at the leading end of the base 87 in order to rapidly and accurately locate the die set to a home position on the bending machine. The locating key 100 is inserted into the keyway 40 of the bend die 34 to be placed or installed on the bending machine with the electromagnets 96 energized and brought into engagement with the top surfaces of the bend die 34, clamp die 35 and pressure die 36. The support arms 92 and 94 are disposed at 90° from one another, and the electromagnets 96 are adjusted along the length of the respective arms to engage spaced surface portions on the top surfaces of the dies 34 to 37. The intermediate bar 93 may be employed when necessary to balance heavy off-center die sets, and the electromagnets 96 can be energized from the control panel of the forklift. The lift mechanism 84 is specifically adaptable for use in lifting die sets without the necessity of placing lift rings 68 in the die sets, for example, as shown in FIG. 2.

In order to place or install a die set onto the bending machine, the lift mechanism 84 is advanced to a position above a selected die set in storage and the support arms lowered until the electromagnets move into engagement with the top surfaces of the dies 34–37 as described. The electromagnets are then energized and the die set lifted and transferred over to the bending machine with the bend die 34 aligned over the spindle 20 and the locating key 100 aligned with the keyway 40. As the die set is lowered over the spindle, the clamp and pressure die brackets 60 are lowered over their respective die holders which have been advanced toward the bend die 34, and the bend die 34 is secured in the usual manner to the spindle 20 by one or more jam nuts 23. The mandrel 50, if required, is secured to the mandrel rod 16 in the manner described. The wiper die 37, if required, is secured to the wiper die holder 49 for radial support. After the dies have been secured, the latches 52 are released and the clamp die 35 and pressure die 36 are retracted to a pre-bend position following which the tube T is removed. If a mandrel was required for the particular die set selected, it will have remained in the tube T and, as noted earlier, is secured to the mandrel rod. The mandrel 50 is therefore retracted from the tube by the retract cylinder 14 and the straight or bent tube T used to help hold the die set together as an assembly is also removed. A new tube T to be bent is inserted into the die set and the mandrel 50 inserted into a new tube T.

In the manner described, each die set or assembly is installed on the tube bending machine with all of the dies in the same exact alignment as when they were removed and therefore does not require the customary individual locating and adjustment of each of the dies. Accordingly, in a manner of minutes, the installed die set is operational and tube bending operations can be resumed. When the job is completed, somewhat the reverse procedure is followed in the removal of the die set from the bending machine. Again, a bent or straight tube corresponding to the size of tube T to be bent by the particular die set is left in place, the latches 52 connected and the clamp die and pressure die holders 26 and 30, respectively, are released. Assuming that no lift rings 68 are provided, the lift mechanism 84 is advanced into position over the die set and the arms 92 and 94 lowered into engagement with the top surfaces of the dies. The lift collars on the arms 92 and 94 are suitably adjusted to place their electromagnets 96 at appropriate positions corresponding to the location of the lift rings 68 as shown in FIG. 2, and the electromagnets are energized to lift the die set after removal of the jamb nut(s) 23 from the spindle 20. The arms 92 and 94 are then raised to lift the die set off of the bending machine table and the arms 92–94 are rotated 90° and the new tooling set lowered in place on the bender as previously described. The removed die set is transferred back to storage for the next production run.

Figure 8:
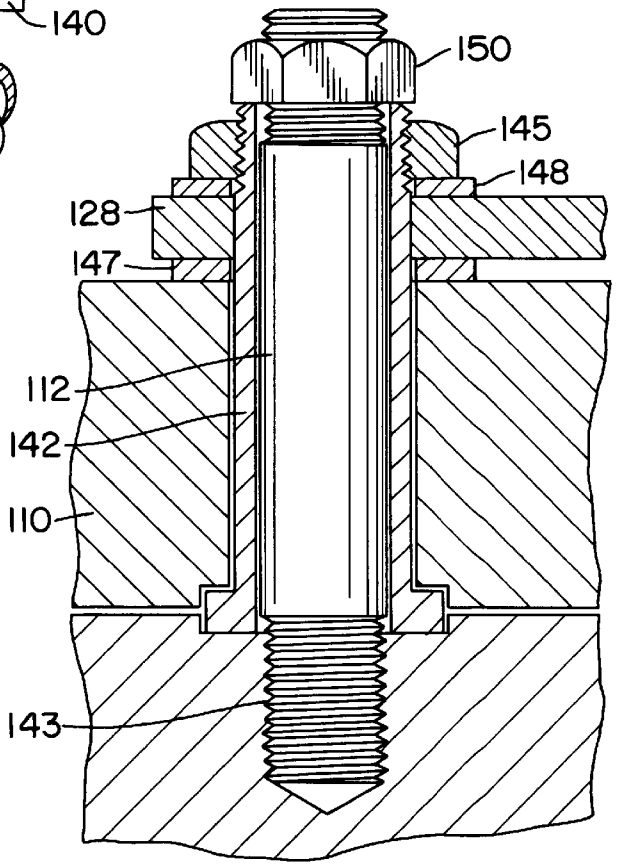
FIG. 8 is a cross-sectional view in more detail of the mounting of the wiper die arm on the spindle.
Figure 6:
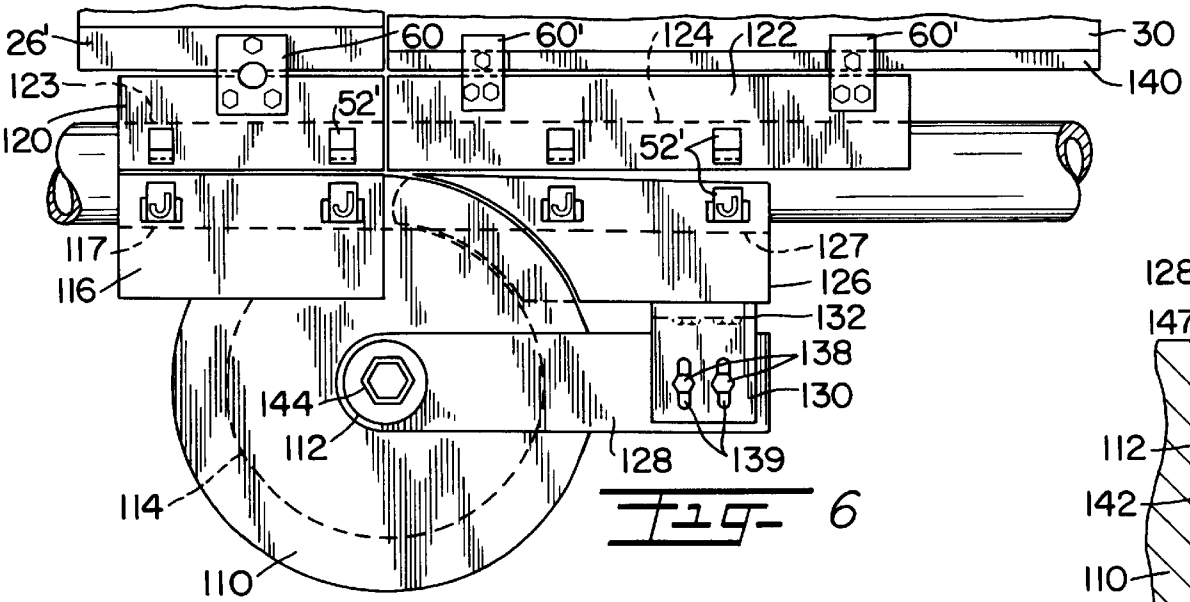
FIG. 6 is a top plan view of a modified form of preassembled die set in accordance with the present invention.
Figure 7:
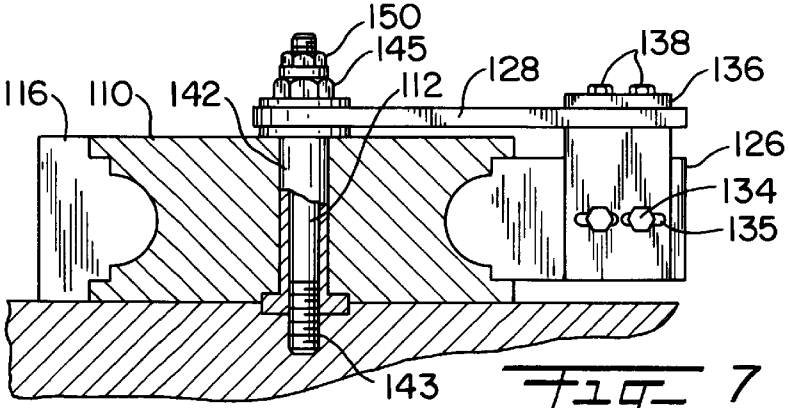
FIG. 7 is a cross-sectional view of the die set shown in FIG. 6.

Another form of die set is illustrated in FIGS. 6 to 8 which is of a type primarily designed for large-radius tube bending. In this form, a circular bend die 110 is mounted on a spindle 112, and the bend die includes a circular tube groove 114 and a clamp insert 116 provided with a tube groove 117 which extends tangentially of the tube groove 114. A clamp die 120 and pressure die 122 are disposed alongside the bend die 110 such that the clamp die tube groove 123 and pressure die tube groove 124 are aligned in facing relation to the bend die tube groove 114 as well as the insert tube groove 117. The wiper die 126 having a tube groove 127 forms a tangential extension of the insert 116. The tube grooves 123 to 124 are also aligned with one another along a common tangent, and a tube T' is inserted between the facing tube grooves 123, 124 and 117, 127.

The wiper die 126 is joined to the bend die 110 by a wiper die arm 128, the arm 128 being in the form of a flat plate provided with an opening at its forward end to receive an upper end of the spindle 112. The wiper die arm 128 extends rearwardly beyond the rear edge of the spindle 112, and an L-shaped crossbar 130 is attached to the rearward end of the arm 128. The crossbar 130 extends transversely from the arm 128 toward the wiper die 126 and has a vertical leg 132 joined to the wiper die 126 by fasteners 134 through slotted openings 135 into one side of the wiper die 126. The upper horizontal leg 136 of the crossbar 130 is secured to the wiper die arm 128 by fasteners 138 extending through slotted openings 139 of the leg.

The wiper die 126 is of the same type as shown in FIG. 2, it being understood that different types of wiper dies can be used, such as, wiper die tips, round-back wipers or self-sustaining tip wiper dies. The clamp insert 117 and wiper die 126 are releasably interconnected to a clamp die 120 and pressure die 122, respectively, by draw latches 52' which correspond to the latches 52 shown in FIG. 2 but are shown in the released position in FIG. 6 after the die set has been installed on the spindle 112. FIG. 6 also illustrates the mounting and disposition of hanger brackets 60' between the top surfaces of the clamp die 120 and clamp die holder 26' as well as between the pressure die 122 and spacer bar 140 which is interposed in a well-known manner between the pressure die 122 and pressure die holder 30.

FIGS. 7 and 8 illustrate in somewhat more detail mounting of the die set of FIG. 6 on the spindle 112, the spindle including a generally sleeve-like adapter 142 extending upwardly from the lower threaded end 143 of the spindle to upper threaded end 144. The upper end of the adapter 142 is externally threaded to receive a jam nut 145 to securely affix the wiper die arm 128 on the top surface of the bend die 110 with compression bearings 147 and 148 therebetween. A spindle jam nut 150 is securely made up on the threaded end 144 to fix the adapter 142 along with the wiper arm 128 and bend die 110 securely in position with respect to the spindle 112.

It will be apparent from the foregoing that stacked tool sets having two or more families of dies of any size or shape can be removed, transferred and relocated on the bender as a complete assembly with each die securely locked in a required bending position to produce an acceptable bent part. Although latches have been described for interconnecting the die sets, it will be apparent that other types of releasable interconnecting elements may be employed, such as, clamps or bolts in retaining the dies in exact aligned operating position with respect to one another. If desired, suitable load cells, not shown may be located behind the clamp and pressure dies, as well as the wiper die, if used, that indicate the optimum force required to produce an acceptable bent part. Bend data records of the necessary forces for specific bent parts facilitate accurate, quick clamp and pressure die pressure settings. The types of dies sets herein set forth and described specifically in relation to FIGS. 1, 2 and 7 to 9 are given more for the purpose of illustration and not limitation and are merely representative of various types of die set assemblies that can be utilized in accordance with the present invention.

It is therefore to be understood that while preferred and modified forms of invention are herein set forth and described, various modifications and changes may be made therein without departing from the spirit and scope of the present invention as appended by the appended claims.

We claim:

1. In tube bending apparatus wherein a die set comprised of a bend die, clamp die and pressure die is mounted on a spindle of a tube bending table, the combination therewith comprising:

first means releasably inter-connecting said pressure die and clamp die to said bend die in predetermined, aligned relation to one another and to said bend die; and handling means for releasably engaging said die set in order to simultaneously lift and remove said die set from said table.

2. In tube bending apparatus according to claim 1, wherein said handling means is further operative to mount another of said die sets on said table, said handling means including locator means to automatically locate said another of said die sets in prealigned relation to said table.

3. In tube bending apparatus according to claim 1, wherein said die set includes a generally cylindrical member corresponding to a tube size to be bent, said cylindrical member being inserted between facing tube grooves on said clamp die and said pressure die and a tube groove on said bending die in order to permit said first means to maintain the dies of each said die set in aligned relation to one another.

4. In tube bending apparatus according to claim 1, wherein said die set includes a generally tubular member corresponding to a tube size to be bent, and a mandrel inserted into said tubular member in order to permit said first means to maintain the dies of each said die set in aligned relation to one another.

5. In tube bending apparatus according to claim 1, wherein said die set includes a wiper die, and second means connecting said wiper die to said bend die.

6. In tube bending apparatus wherein a plurality of preassembled die sets are provided, each of said die sets including a bend die, clamp die and pressure die mounted on a spindle of a bending machine table for bending a preselected size of tube, the improvement comprising:

latch means releasably interconnecting said pressure die and clamp die to said bend die in aligned, predetermined relation to one another; and lift means for releasably engaging said die set whereby to simultaneously lift and remove said dies of each said die set from said table and replacing with another die set.

7. In tube bending apparatus according to claim 6 wherein each said die set includes a tube corresponding to the size of a tube to be bent inserted between facing tube grooves of said clamp die and said pressure die on one side and said bend die on a diametrically opposed side of said tube in order to permit said first means to maintain the dies of each said die set in aligned relation to one another.

8. In tube bending apparatus according to claim 6 wherein said lift means includes locator means to automatically locate said other die set in prealigned relation to said table.

9. In tube bending apparatus according to claim 6 wherein said latch means includes a plurality of latch members at spaced horizontal intervals between top surfaces of said clamp die and said bend die and between said pressure die and said wiper die.

10. In tube bending apparatus according to claim 6 wherein hanger brackets are mounted on said clamp die and said pressure die, and lift rings are mounted on a top surface of each said die set.

11. In tube bending apparatus according to claim 7 wherein each said die set includes a mandrel inserted into said tube and a wiper die connected to said bend die.

12. In tube bending apparatus according to claim 11 wherein a wiper die arm releasably interconnects said wiper die to said spindle.

13. In tube bending apparatus according to claim 11 wherein a wiper die holder is interconnected between said table and said wiper die.

14. In tube bending apparatus according to claim 8 wherein said lift means includes spaced, horizontally extending support arms, and electromagnetic members on each of said support arms.

15. In tube bending apparatus according to claim 14 wherein said lift means is operative to lower said support arms into engagement with a top surface of said die set and to lift said die set by magnetic attraction.

16. The method of changing die sets for a tube bending machine wherein each of a plurality of die sets is comprised of a bend die, clamp die and pressure die, the steps comprising:

(a) mounting each said die set on a spindle support of said machine with said pressure die and said clamp die aligned with one another and with said bend die;

(b) releasably interconnecting said dies of each of said die sets with connectors extending between top surfaces of said dies in prealigned relation to one another for bending a selected size of tube;

(c) positioning clamp and pressure die holders into engagement with each said die set and releasing said connectors from engagement with each said die set;

(d) bending one or more tubes of said selected size by inserting each said tube in succession into each said die set; and (e) releasing said clamp and pressure die holders and connecting said connectors to releasably interconnect said dies of each said die set followed by lifting each said die set and removing from said spindle support.

17. The method according to claim 16 including the further step of replacing each said die set with another die set and repeating the sequence of steps (a) through (e) above.

18. The method according to claim 16 wherein one of said tubes remains inserted between said dies of each said die set when lifted and removed from said spindle support in order to permit said connectors to maintain the dies of each said die set in aligned relation to one another.

19. The method according to claim 16 wherein each of said die sets includes a wiper die connected to said bend die and further including the step of releasably interconnecting said pressure die to said wiper die.

20. The method according to claim 16 wherein step (e) is characterized by electromagnetically lifting and lowering each of said die sets.

21. The method according to claim 18 including the step of inserting a mandrel into each said tube of said die set when said die set is mounted on said spindle support.

* * * * *